US009986875B2

(12) United States Patent
Mehdizadeh

(10) Patent No.: US 9,986,875 B2
(45) **Date of Patent: *Jun. 5, 2018**

(54) CONTAINER AND CAP FOR DISPENSING WIPES

(71) Applicant: Sharmin Mehdizadeh, Great Neck, NY (US)

(72) Inventor: Sharmin Mehdizadeh, Great Neck, NY (US)

( * ) Notice: Subject to any disclaimer, the term of this patent is extended or adjusted under 35 U.S.C. 154(b) by 496 days.

This patent is subject to a terminal disclaimer.

(21) Appl. No.: 14/551,890

(22) Filed: Nov. 24, 2014

(65) Prior Publication Data

US 2015/0114984 A1 Apr. 30, 2015

Related U.S. Application Data

(63) Continuation of application No. 14/061,901, filed on Oct. 24, 2013, now abandoned.

(51) Int. Cl.

| | |
|---|---|
| ***B65D 81/24*** | (2006.01) |
| ***A47K 10/42*** | (2006.01) |
| ***B65D 47/08*** | (2006.01) |
| *A47K 10/32* | (2006.01) |

(52) U.S. Cl.

CPC ..... *A47K 10/421* (2013.01); *B65D 47/0871* (2013.01); *A47K 2010/3266* (2013.01); *B65D 2251/1058* (2013.01); *B65D 2251/1066* (2013.01)

(58) Field of Classification Search

CPC ..... A47K 10/3836; A47K 2010/3266; B65D 83/0805

USPC ..... 206/205, 210, 233, 449, 494, 812; 220/254.3, 254.4, 254.5, 259.1, 293, 324, 220/810, 820; 221/33, 34, 45, 48, 63

See application file for complete search history.

(56) References Cited

U.S. PATENT DOCUMENTS

| | | | |
|---|---|---|---|
| 3,843,017 | A | 10/1974 | Harrison |
| 4,017,002 | A | 4/1977 | Doyle et al. |
| 4,180,160 | A | 12/1979 | Ogawa et al. |

(Continued)

FOREIGN PATENT DOCUMENTS

| | | |
|---|---|---|
| EP | 1 401 733 B1 | 5/2002 |

OTHER PUBLICATIONS

Photograph #1—of Clorox Disinfecting Wipes Product on market prior to Oct. 24, 2012.

(Continued)

*Primary Examiner* — Luan K Bui

(74) *Attorney, Agent, or Firm* — Donald E. Hasse; Hasse & Nesbitt, LLC

(57) ABSTRACT

A container for wipes, and a cap for the container, having a pop-up style dispensing means positioned beneath a reclosable lid. The container may be an upright cylindrical container for perforated wipes or a rigid tub for interfolded wipes. The dispensing means comprises a raised member made of flexible, rubber-like material, having at least one opening through which wipes are removed when the lid is open. When the lid is closed it compresses the raised member. When the lid is released from its closed position the raised member pushes the lid open. The dispensing means may have a hard plastic backing member underneath a portion of the rubber-like material adjacent the opening through which wipes are removed.

22 Claims, 6 Drawing Sheets

(56) References Cited

U.S. PATENT DOCUMENTS

| | | | | |
|---|---|---|---|---|
| 4,185,754 | A | 1/1980 | Julius | |
| 4,219,129 | A * | 8/1980 | Sedgwick | 221/63 |
| 5,699,912 | A * | 12/1997 | Ishikawa et al. | 206/494 |
| 5,718,353 | A * | 2/1998 | Kanfer et al. | 221/63 |
| 5,908,138 | A * | 6/1999 | Vlahakis et al. | 221/63 |
| 6,206,221 | B1 * | 3/2001 | Bando et al. | 220/254.5 |
| 6,364,101 | B1 * | 4/2002 | Schultz | 206/210 |
| 6,394,298 | B1 * | 5/2002 | Zaidman | 220/259.1 |
| 6,523,690 | B1 | 2/2003 | Buck et al. | |
| 6,786,447 | B2 | 9/2004 | Geib et al. | |
| 7,597,213 | B2 | 10/2009 | McDonald | |
| 7,614,519 | B2 | 11/2009 | Krauth et al. | |
| 2010/0206896 | A1 * | 8/2010 | Ray et al. | 221/45 |
| 2012/0145737 | A1 * | 6/2012 | Ray et al. | 221/45 |
| 2013/0175271 | A1 * | 7/2013 | Lim | 220/254.5 |

OTHER PUBLICATIONS

Photograph #2—of Clorox Disinfecting Wipes Product on market prior to Oct. 24, 2012.
Photograph #3—of Clorox Disinfecting Wipes Product on market prior to Oct. 24, 2012.
Photograph #4—of Clorox Disinfecting Wipes Product on market prior to Oct. 24, 2012.
Photograph #5—of Cottonelle Moist Toilet Tissue Dispenser Product on market prior to Oct. 24, 2012.
Photograph #6—of Cottonelle Moist Toilet Tissue Dispenser Product on market prior to Oct. 24, 2012.
Photograph #7—of Cottonelle Moist Toilet Tissue Dispenser Product on market prior to Oct. 24, 2012.
Photograph #8—of Cottonelle Moist Toilet Tissue Dispenser Product on market prior to Oct. 24, 2012.
Photograph #9—of Cottonelle Moist Toilet Tissue Dispenser Product on market prior to Oct. 24, 2012.
Photograph #10—of Huggies Natural Care Wipes Product on market prior to Oct. 24, 2012.
Photograph #11—of Huggies Baby Wipes Product on market prior to Oct. 24, 2012.
Mehdizadeh, U.S. Appl. No. 14/061,911, filed Oct. 24, 2013.
Mehdizadeh, U.S. Appl. No. 14/551,926, filed Nov. 24, 2014.
Mehdizadeh, U.S. Appl. No. 14/061,901, filed Oct. 24, 2013.
Mehdizadeh, U.S. Appl. No. 14/551,890, filed Nov. 24, 2014.

* cited by examiner

CONTAINER AND CAP FOR DISPENSING WIPES

CROSS-REFERENCE TO RELATED APPLICATION

This application is a continuation-in-part of application Ser. No. 14/061,901, filed on Oct. 24, 2013, the disclosure of which is incorporated herein by reference in its entirety.

FIELD OF THE INVENTION

This invention relates to containers and caps for containers that dispense wipes, including wet and dry wipes. More particularly, the invention relates to improved containers and caps for wipes having a pop-up style dispensing means positioned beneath a reclosable lid.

BACKGROUND OF THE INVENTION

A variety of containers are available for dispensing wipes. These include reach-in and pop-up containers. Some pop-up containers provide a stack of interfolded flat wipes, which are commonly dispensed from a tub. Other pop-up containers provide a roll of wipes that are perforated between sheets and dispensed from an upright cylindrical container.

If the pop-up feature of a container fails, for example with missed interfolds or when a wipe falls back into the container, the user needs to reach into the container to retrieve the next wipe. Some pop-up containers do not have openings large enough or flexible enough for the user to reach into the container. The user thus has to remove the cap or lid in such designs to restart the roll or stack of wipes from the underside of the opening. Other containers for wet wipes have openings that do not provide a sufficiently good seal to prevent the wipes from drying out over time. In containers having perforated wipes, such as upright cylindrical containers, the wipes may not properly tear along the perforations. This can result in multiple wipes being dispensed instead of a single wipe, or the user may need both hands to tear the lead wipe along its perforation line. Flaps or edges have been added to containers to improve separation of wipes or tearing of perforated wipes, but these can increase complexity of the design and may scratch or cut fingers if the user reaches into the container to pull out a wipe. Thus, there is a continuing need for improved containers and cans for dispensing wipes.

SUMMARY OF THE INVENTION

The present invention relates to a container for wipes having a pop-up style dispensing means positioned beneath a reclosable lid, said dispensing means comprising a raised member made of flexible, rubber-like material having at least one opening therein through which individual wipes are removed from the container when the lid is open, wherein when the lid is in a closed position it at least partially compresses the raised member and when the lid is released from its closed position the raised member pushes the lid open.

The invention also relates to a cap for a container for wipes, said cap having a pop-up style dispensing means positioned beneath a reclosable lid, said dispensing means comprising a raised member made of flexible, rubber-like material having at least one opening therein through which individual wipes are removed from the container when the lid is open, wherein when the lid is in a closed position it at least partially compresses the raised member and when the lid is released from its closed position the raised member pushes the lid open.

DETAILED DESCRIPTION OF THE DRAWINGS

As used herein, the term "container" means any container suitable for storing and dispensing wipes including, but not limited to, canisters, tubs, soft packs, and the like.

As used herein, the term "interfolded wipes" means a plurality of wipes, such as in a stack of wipes, in which separate individual wipes are releasably attached to each other by folding an edge of one wipe over an edge of an adjacent wipe.

As used herein, the term "perforated wipes" means a plurality of wipes, such as in a stack or roll, in which individual wipes are defined and interconnected by a series of perforation lines in a continuous sheet, such that each wipe can be detached from the remaining wipes by tearing the sheet along the line of perforations.

Both interfolded wipes and perforated wipes can be used with the containers and caps of the invention. However, as described below, the containers and caps herein are particularly useful for dispensing perforated wipes, particularly wet wipes, from a roll. Such perforated wipes are typically in an upright cylindrical container. Interfolded wipes herein are typically contained within a rigid tub or a soft pack which may have a rigid cap and lid.

Figure 1:
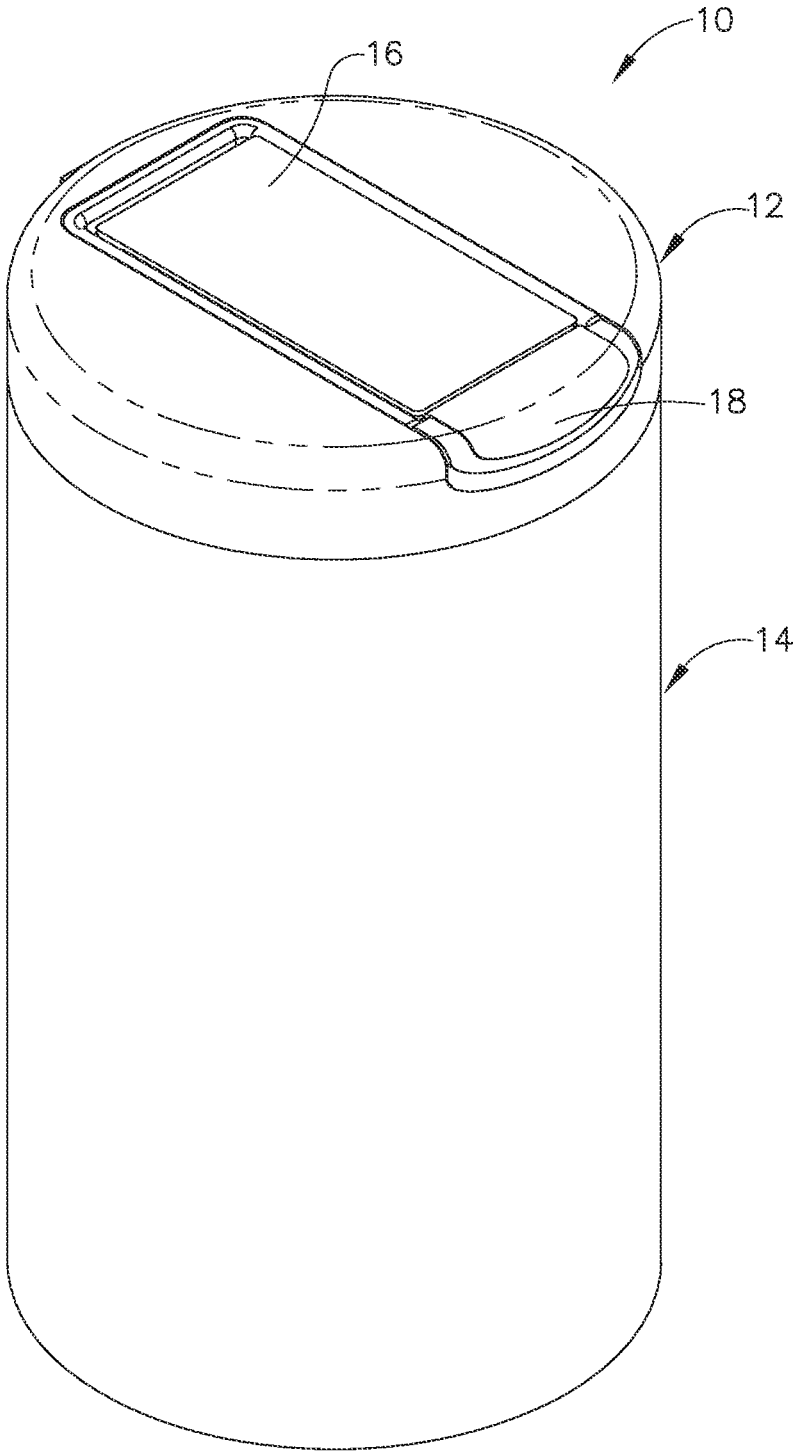
FIG. 1 is a perspective view of a container and a cap of the invention.

FIG. 1 illustrates an upright cylindrical container 10 of the invention having a cap 12, a lid 16 hingedly attached thereto via hinge 20 (shown in FIG. 2), and a base 14 for storing the wipes. Cap 12 typically is a removable cap made of plastic material, either resilient or hard plastic, adapted to form an air and moisture tight fit with base 14, typically also made of resilient or hard plastic material. The cap, lid and base may each be made of any suitable plastic material, for example, HDPE, LDPE, PS (polystyrene), PET, PVC, or other engineering plastic. The cap can be fitted to the base of the container in any suitable manner. For example, the cap can have a friction fit, a snap-on fit, a screw-type fit, a twist-on/twist-off fit, or an adhesive fit. A removable seal or liner in the form of a membrane, plastic or foil may be applied under the cap or over the base to seal the container, for example to prevent loss of moisture in the container, prior to use.

Figure 2:
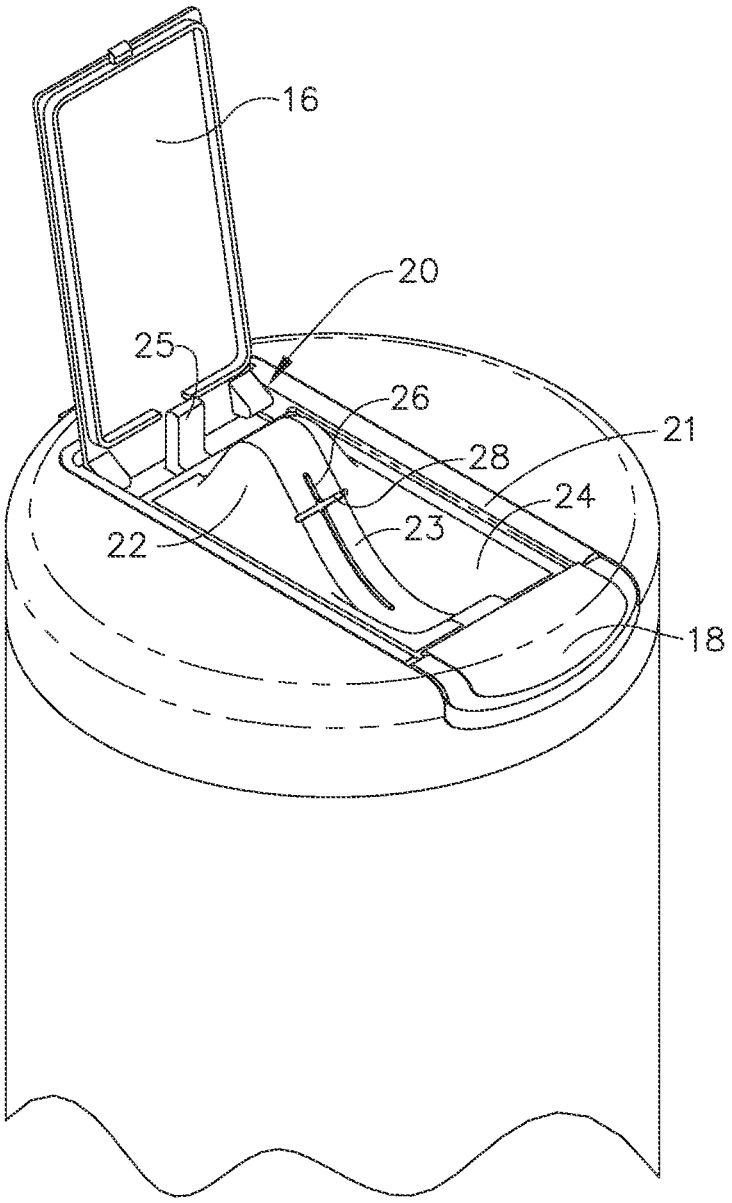
FIG. 2 is a perspective view of the top portion of the container and cap of FIG. 1 with the lid open.
Figure 4:
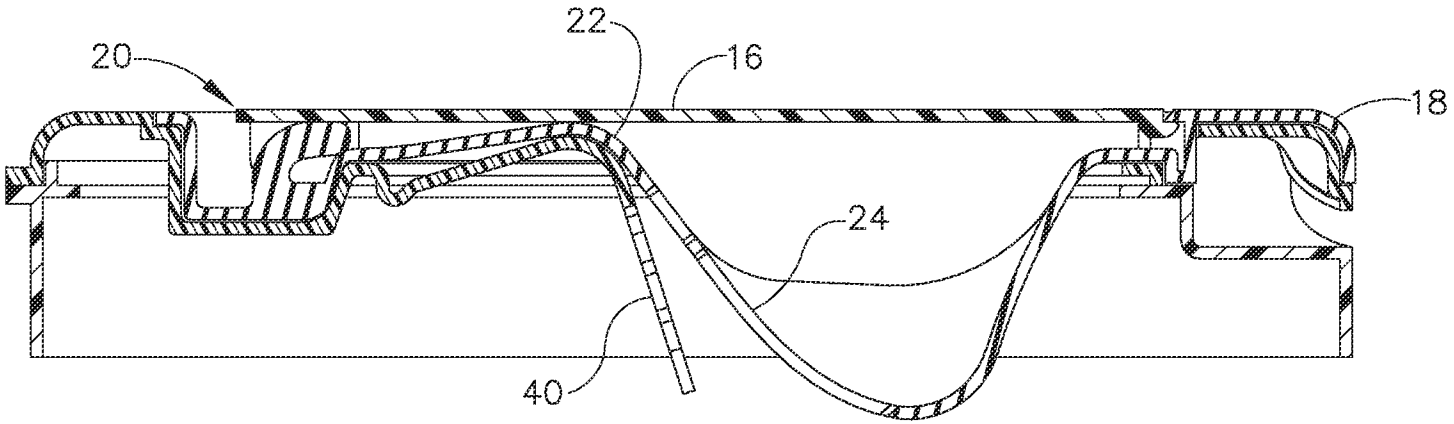
FIG. 4 is an enlarged sectional view of the cap of FIG. 1 with the lid closed.
Figure 5:
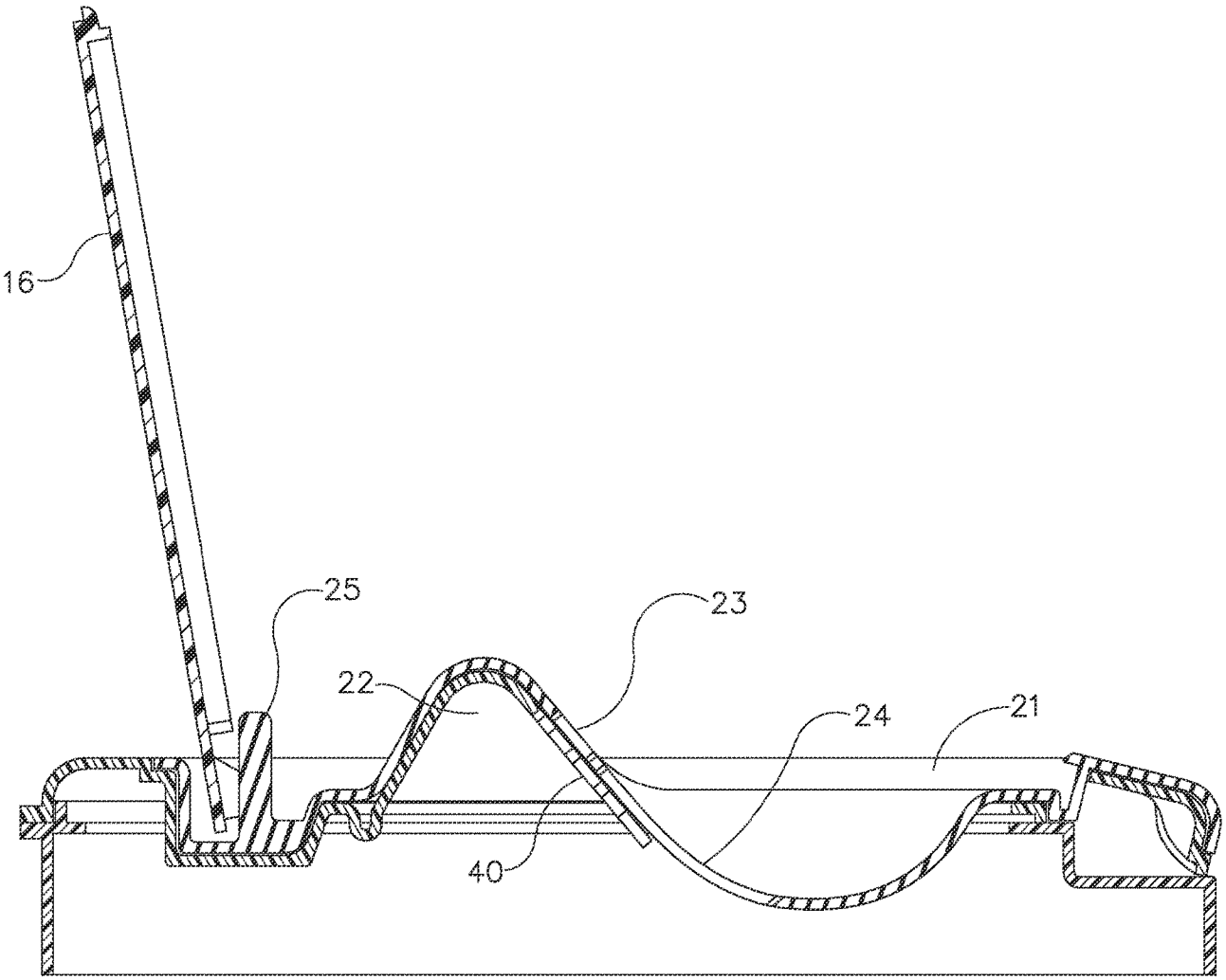
FIG. 5 is an enlarged sectional view of the cap of FIG. 1 with the lid open.
Figure 6:
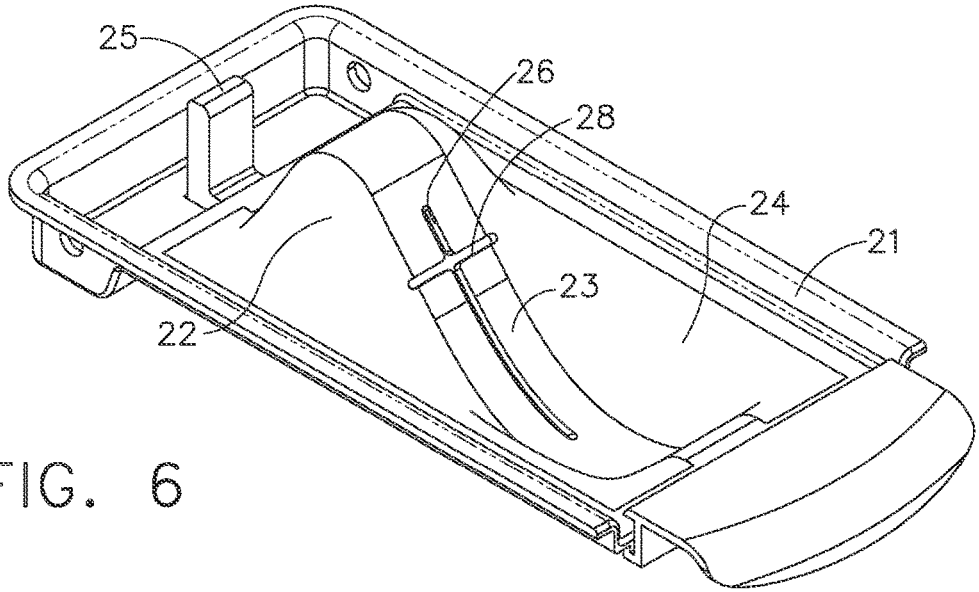
FIG. 6 is an enlarged perspective view of a portion of the cap in FIG. 2.

Cap 12 has a button 18 along or near the front periphery of the cap. A button or other release means may be positioned at other points on the cap, for example, on the sides or back of the cap. When the user depresses button 18, the front portion of lid 16, opposite the rear portion of the lid that is hingedly attached to the cap via hinge 20, is released to provide access to a pop-up style dispensing means for wipes, as shown in FIG. 2. However, unlike conventional containers, container 10 does not require, and typically does not have, a spring mechanism to pop open lid 16. Such spring mechanisms increase the cost and complexity of containers and often fail after repeated use. In container 10 of the invention, a raised member 22 made of flexible, rubber-like material pushes lid 16 open when the front of the lid is released by pushing button 18. As shown in FIG. 4, when lid 16 is closed it at least partially compresses raised member 22. When the user depresses button 18 to release the front of lid 16 from its closed position, raised member 22 at least substantially returns to its normal (non-compressed) position and pushes lid 16 upward and at least partially open, as shown in FIG. 5. The raised member thus provides an internal spring action without the need to add a separate spring mechanism like used in conventional containers. In the embodiment shown in FIG. 2, a protrusion 25, typically also made of flexible, rubber-like material, near the back portion of lid 16 also contributes to pushing the lid open. While the protrusion 25 shown has a rectangular shape, the shape, size and material of the protrusion can be varied to meet the needs of the particular container. As shown in FIG. 4, when lid 16 is closed it at least partially compresses protrusion 25, pushing it downward and forward toward the front of the cap. When the user depresses button 18 to release the from of lid 16 from its closed position, protrusion 25 at least substantially returns to its normal positions and further pushes lid 16 upward and open, as shown in FIG. 5. The protrusion also keeps the lid in an open position and prevents the lid from falling down when the user is dispensing a wipe, until the user purposely closes the lid to seal the container.

Figure 7:
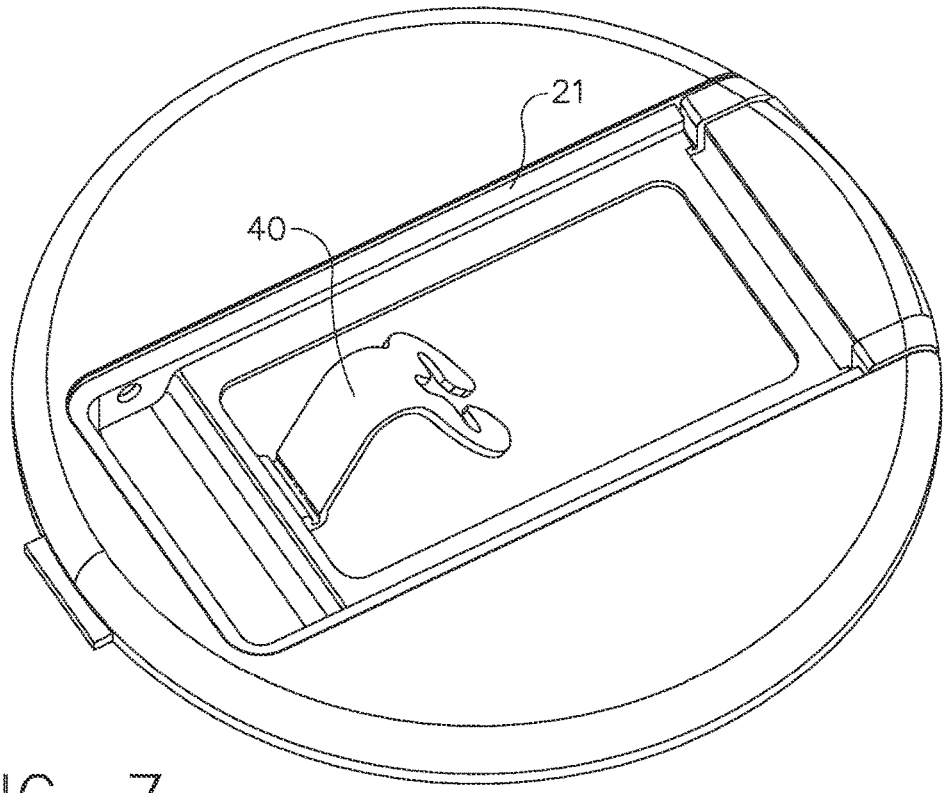
FIG. 7 is an enlarged top perspective view of a portion of the cap of FIG. 1.

Cap 12 further comprises an insert member 21, as shown in FIG. 2. Insert member 21 is typically made of flexible, rubber-like material, but it may be made of hard plastic or resilient plastic material. A lip around the periphery of the insert member engages with an opening (not shown) in the top surface of the cap so the insert member can be fit securely into the top of the cap, as shown in FIG. 7. While the insert member shown is rectangular, it can have any shape and size large enough to contain the dispensing means and enable the user to reach into the container to grasp the next available wipe in the event of a dispensing failure. The insert member may have other suitable shapes, including, without limitation, square, oval, circular, triangular and irregular shapes.

Figure 3:
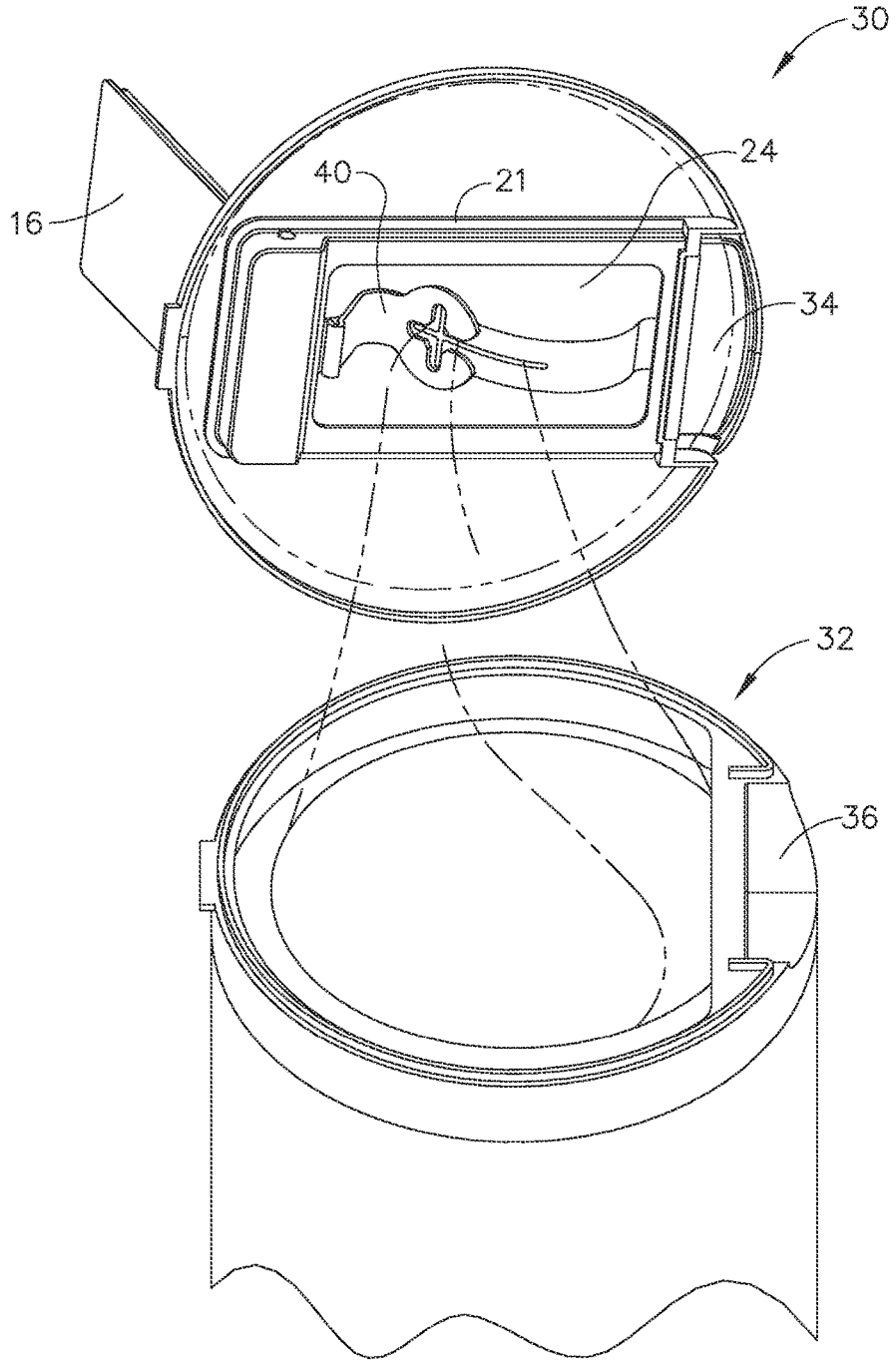
FIG. 3 is a perspective view of the bottom of a top portion of the cap in FIG. 2.

As shown in FIG. 3, cap 12 has a top portion 30 and a bottom portion 32 that attaches to base 14 of the container in any suitable manner. For example, the top portion of the cap can be hingedly attached to the bottom portion, which can have a friction fit, a snap-on fit, a screw-type fit, an adhesive fit, or a molded fit to the base of the container. The back portion of lid 16 is hingedly attached via hinge 20 to insert member 21, which is inserted into the top portion of the cap. The front portion of lid 16 is secured in a closed position to the front of the cap by a suitable latching mechanism. When the user depresses button 18, the bottom portion 34 thereof engages support piece 36 in the bottom portion 32 of the cap and releases the front portion of lid, as shown in FIGS. 3-5.

The dispensing means of the invention comprises a raised member made of flexible, rubber-like material having at least one opening therein through which individual wipes are removed from the container when the lid is open. The at least one opening may have any suitable shape and size, for example the opening can be rectangular, oval, round, circular, triangular, star-shaped, or irregular shaped, but typically is a narrow slit. In FIG. 2, raised member 22 has two intersecting slits 26 and 28 which create a "cross" slit configuration through which individual wipes are removed from the container.

As also shown in FIG. 2 and FIG. 5, raised member 22 has a front surface 23 that is inclined upward toward lid 16 at an angle of from about 20 degrees to about 60 degrees, typically from about 30 degrees to about 50 degrees, for example about 45 degrees, relative to the horizontal plane of the top surface of the cap. Such an angled surface makes it easier for the user to pull the wipe from the container toward themselves, and provides sufficient friction at the dispensing opening to tear or separate a wipe from the next wipe in the container. In conventional containers, the dispensing opening typically is parallel to, and/or slightly recessed from, the plane of the horizontal lid and top surface of the cap. This results in a wipe pull angle close to 90 degrees, relative to the lid and top surface of the cap, which is uncomfortable for a user holding the container in the usual manner. When the user adjusts to a comfortable pulling angle, there is high friction at the dispensing opening, which can lead to tearing or entanglement of the wipe in the opening. In the present invention, the user nulls the wipe at a smaller angle that is more comfortable and provides less, but still sufficient, friction at the dispensing opening to properly separate a wipe from the next wipe in the container. The pull angle is typically from about 20 degrees to about 60 degrees, more typically from about 30 degrees to about 50 degrees, for example about 45 degrees, relative to the horizontal plane of the top surface of the cap.

Referring again to FIGS. 2 and 5, the from surface 23 of the raised member 22 has at least one slit therein through which individual wipes are removed, but typically has at least two intersecting slits which create a "cross" slit configuration, such as vertically inclined slit 26 and horizontal slit 28 shown in FIG. 2. The slits are shown as intersecting at an angle of about 90 degrees, but may intersect at any suitable angle, for example up to about 135 degrees. In another embodiment, a portion of the at least one slit extends into a recessed area 24 made of flexible, rubber-like material that is adjacent the raised member 22. The lower portion of inclined slit 26 that extends into recessed area 24 helps retain individual wipes in the slit opening and prevent them from falling back into the container. This provides convenience because the user does not have to reach into the container to retrieve a wipe that has fallen back into the container as frequently happens with conventional containers. Moreover, this feature avoids possible contamination of interior surfaces of the container and other wipes therein that the user might contact when reaching into the container to retrieve a fallen wipe. The recessed area 24 also functions as a well or catch basin for liquid dripping from a wipe being dispensed or from fingers of the user, such as perspiration, emollients or other liquid the user has contacted. Such liquid can be poured out of the recessed area simply by tilting the container to the side, or wiped from the recessed area, by using an absorbent, material, which may contain an antibacterial or disinfection agent. The recessed area can thus prevent contamination of container surfaces and unused wipes in the container.

In one embodiment, the dispensing means is recessed within cap 12 so that when lid 16 is closed, the top surface of the lid and the top surface of the cap are flat and in the same horizontal plane, as shown in FIGS. 1 and 4. In another embodiment, the pop-up style dispensing means can be located beneath a cover or the cap of the container that can be closed to seal the container when not in use. In both such designs, the recessed area 24 also functions to provide space for holding the next wipe that will be dispensed. Conventional canisters typically do not nave sufficient space for the wipe to rest when the lid is closed. This can prevent the lid from being easily or fully closed, and lead to moisture loss from the container. However, in the present invention, the tail of the next wipe to be dispensed can sit in the recessed area, leaving room for the lid to be fully closed. This seals the container and prevents loss of moisture from the wipes therein.

The configuration and the length of the slit(s) in the flexible, rubber-like material can vary based on a number of factors, including evaporation losses, ease of wipe removal, sufficient frictional engagement to maintain the pop-up feature, and access to the wipes within the container in the event the pop-up feature fails. In one embodiment, the flexibility of the rubber-like material and the length of the at least one slit are sufficient to enable a user to reach into the container and retrieve a wipe in the event the pop-up feature fails. In another embodiment, the flexibility of the rubber-like material and the length of the at least one slit sufficiently seal moisture in the container to prevent substantial dry-out of wet wipes in the container. Intersecting slits works well to meet the foregoing considerations. Moreover, users may push a popped-up wipe back into the container to improve moisture retention or to more readily maintain sanitary conditions, and thereafter easily retrieve the wipe. The raised member 22 and recessed area 24 are also believed to contribute to sealing the dispensing opening around an individual wipe being held in the opening or when the wipe is pushed back into the container. In particular, the raised member and recessed area are believed to help compress together or crinkle the rubber-dike material at and under the opening(s) through which wipes are dispensed. This improves sealing of the opening(s), which reduces moisture vapor transmission out of the container and helps keep moisture levels in the wipes more stable and intact over a period of time. Inside the container, the raised member and recessed area also act as an apex on which moisture vapor/liquid will collect and then drip or run down surfaces back into lower portions of the container, again helping to keep moisture levels more stable.

The slits in the flexible, rubber-like material are shown in the drawings as linear intersecting slits. Typically, the longest slit is about 1-2 inches long and the smaller slit is about 0.25-0.5 inches long. However, other slit configurations are also suitable, including star-shaped slits, X-shaped slits, straight slits and curvilinear slits. The length of individual slits can be about 0.25 to about 3 inches, more specifically from about 0.25 to about 2 inches. The length of the slits will in part depend upon the slit configuration and the number of slits. Typically, at least one slit has a length of at least about 1 inch which, in combination with the elasticity of the rubber-like sheet or material, will allow the user to reach into the container with at least two fingers as necessary. For tall containers, it may be necessary to lengthen at least one of the slits so that the user can still reach far into the container. For such a container, at least one of the slits may be between 1 and 4 inches in length, typically between 2 and 3 inches in length. This will allow the user to insert one or more fingers as well as part of the hand into the container to retrieve a wipe.

The flexible, rubber-like material having the slits should be sufficiently stiff to maintain a reasonable impediment to evaporation losses and to hold the wipes in the pop-up position. At the same tune, it should be elastic enough to enable the user to reach into the container with the fingers sufficiently far, without hurting his/her fingers, to grasp a wipe from the top of the stack, even when the stack is down to one remaining wipe. To meet these requirements, the properties of the flexible, rubber-like material combine with the selected slit configuration to attain the desired end result. It will be appreciated that as the length of the slits increases or as the stiffness decreases, it becomes easier to reach one's finger into the container because the opening is larger. Although the rubber-like material can take many forms, a sheet form is readily made for commercial purposes.

The properties of the rubber-like material can be described in terms of the hardness, stiffness, thickness and elasticity. In one embodiment, the Shore A hardness (as measured by ASTM D2240) of the flexible, rubber-like material can be about 100 or less, more specifically from about 20 to about 70, and still more specifically from about 30 to about 60. The Gurley stiffness of the flexible, rubber-dike material (as measured by ASTM D 6125-97 "Standard Test Method for Bending Resistance of Paper and Paperboard") can be about 10,000 milligrams of force (mgf) or less, more specifically from about 100 to about 8000 mgf, more specifically from about 200 to about 6500 mgf, and still more specifically from about 300 to about 1500 mgf. The thickness of the flexible, rubber-like base can be about 0.1 millimeter or greater, more specifically from about 0.1 to about 2 millimeters, and still more specifically from about 0.8 to about 1.5 millimeters. The elasticity of the flexible rubber-like material, as characterized by the tensile stress at 100 percent elongation and measured in accordance with ASTM D412 "Standard Test Methods for Vulcanized Rubber and Thermoplastic Elastomers", can be about 10 megapascals (Mpa) or less, more specifically from about 0.1 to about 7 Mpa, and still more specifically from about 0.5 to about 2.5 Mpa.

In another embodiment of the invention, the dispensing means further comprises a hard plastic backing member underneath a portion of the rubber-like material adjacent the at least one opening through which individual wipes are removed from the container. The backing member provides a hard surface, for example an edge, to help separate or tear the leading wipe from the next wipe in the container, but does not otherwise obstruct removal of wipes through the at least one opening. The backing member thus does not completely surround the at least one opening, which could make if difficult to reach into the container to retrieve the next wipe in the container. The backing member typically contacts and supports at least a portion of the rubber-like material. The backing member typically adds rigidity and structure, for example, like a bone or skeletal structure, to the rubber-like material adjacent the opening(s) through which individual wipes are removed. The backing member may be made of any suitable plastic material, for example, HDPE, LDPE, PS (polystyrene), PET, PVC, or other engineering plastic. Typically, the backing member is underneath a portion of the rubber-like material that is adjacent the at least two intersecting slits which create the "cross" slit configuration. The backing member typically is underneath a portion of the raised member. As shown in FIGS. 3-6 and 7, hard plastic backing member 40 is underneath a portion of raised member 22, including an upper portion of the rubber-like material adjacent slits 26 and 28 near their intersection. However, backing member 40 does not extend underneath the rubber-like material adjacent the lower portion of slit 26 that extends into recessed area 24. In other embodiments, the backing member may be covered by, e.g., coated with, the rubber-like material or encased within the rubber-like material. In such embodiments, the backing member may be less rigid and more flexible, which can improve separation and dispensing of individual wipes from the container. In some embodiments, the rubber-like material acts like a flexible, expandable and contractible clamp around a dispensing opening that can flex outward if a wipe has more bulk than other wipes or flex inward if a wipe has less bulk than other wipes. The rubber-like material and the backing member thus help to right-size the dispensing opening(s) to changes in the size of a wipe, imperfection in a wipe, or the angle at which a wipe is being dispensed. This minimizes the problem of thin wipes slipping through a dispensing opening without enough friction to tear and separate them, sometimes referred to as "roping", and the problem of thicker wipes jamming in a dispensing opening. The present invention thus provides a more continuous flow of wipes dispensed one at a time as desired by the user.

In another embodiment of the invention, the container is a flexible package, such as a plastic film-wrapped package, having a flip-top style dispensing opening. Such a flexible plastic film package may contain a stack of wipes. A dispensing means is provided on the top of the package, which dispensing means comprises a rigid port surrounding a flexible, rubber-like material having one or more slits through which the wipes are removed from the package. The flip-top lid can be closed over the rigid port to seal off the container when not being used. Any suitable closure design can be used to affect a proper seal.

While the invention has been illustrated in a particular style of container, those skilled in the art will appreciate that many different container designs are possible, including rigid, rectangular tub containers and flexible package containers, such as a plastic film-wrapped package, without departing from the scope of the invention. While particular embodiments of the invention have been described, it will be apparent to those skilled in the art that various changes and modifications can be made without departing from the scope of the invention. Thus, the foregoing description is not to be construed as limiting the scope of the invention, which is defined by the following claims and all equivalents thereto.

What is claimed is:

1. A container for wipes having a pop-up style dispensing means positioned beneath a reclosable lid, said dispensing means comprising a raised member made of flexible, rubber-like material having at least one slit opening therein on a front surface of the raised member through which individual wipes are removed from the container when the lid is open, wherein when the lid is in a closed position it at least partially compresses the raised member and when the lid is released from its closed position the raised member pushes the lid open.

2. The container of claim 1 in the form of an upright cylindrical container for perforated wipes.

3. The container of claim 1 in the form of a rigid tub for interfolded wipes.

4. The container of claim 1 wherein the rubber-like material and the length of the at least one slit opening are sufficient to enable a user to reach into the container and retrieve a wipe in the event the pop-up feature fails.

5. The container of claim 1 wherein the rubber-like material and the length of the at least one slit opening sufficiently seal moisture in the container to prevent substantial dry-out of wet wipes in the container.

6. The container of claim 1 wherein the at least one slit opening has two intersecting slits which create a "cross" slit configuration through which individual wipes are removed from the container.

7. The container of claim 1 wherein the raised member has a front surface that is inclined upward toward the back of the lid at an angle of from about 20 degrees to about 60 degrees when the lid is open.

8. The container of claim 7 wherein the front surface of the raised member is inclined upward toward the back of the lid at an angle of from about 30 degrees to about 50 degrees when the lid is open, and the at least one slit opening has two intersecting slits which create a "cross" slit configuration.

9. The container of claim 1 wherein a portion of the at least one slit opening extends into a recessed area made of flexible, rubber-like material adjacent the raised member and said portion helps retain individual wipes in the at least one slit opening and prevent them from falling back into the container.

10. The container of claim 1 wherein the pop-up style dispensing means is recessed within a cap having a button along a front periphery of the cap, wherein when the button is depressed a front portion of the lid, opposite a rear portion of the lid hingedly attached to the cap, is released to provide access to the pop-up style dispensing means.

11. The container of claim 1 wherein the dispensing means further comprises a hard plastic backing member underneath a portion of the rubber-like material adjacent the at least one slit opening through which individual wipes are removed from the container.

12. A cap for a container for wipes, said cap having a pop-up style dispensing means positioned beneath a reclosable lid, said dispensing means comprising a raised member made of flexible, rubber-like material having at least one slit opening therein on a front surface of the raised member through which individual wipes are removed from the container when the lid is open, wherein when the lid is in a closed position it at least partially compresses the raised member and when the lid is released from its closed position the raised member pushes the lid open.

13. The cap of claim 12 for an upright cylindrical container containing perforated wipes.

14. The cap of claim 12 for a rigid tub containing interfolded wipes.

15. The cap of claim 12 wherein the rubber-like material and the length of the at least one slit opening are sufficient to enable a user to reach into the container and retrieve a wipe in the event the pop-up feature fails.

16. The cap of claim 12 wherein the rubber-like material and the length of the at least one slit opening sufficiently seal moisture in the container to prevent substantial dry-out of wet wipes in the container.

17. The cap of claim 12 wherein the at least one slit opening has two intersecting slits which create a "cross" slit configuration through which individual wipes are removed from the container.

18. The cap of claim 12 wherein the raised member has a front surface that is inclined upward toward the back of the lid at an angle of from about 20 degrees to about 60 degrees when the lid is open.

19. The cap of claim 18 wherein the front surface of the raised member is inclined upward toward the back of the lid at an angle of from about 30 degrees to about 50 degrees when the lid is open, and the at least one slit opening has two intersecting slits which create a "cross" slit configuration.

20. The cap of claim 12 wherein a portion of the at least one slit opening extends into a recessed area made of flexible, rubber-like material adjacent the raised member and said portion helps retain individual wipes in the at least one slit opening and prevent them from falling back into the container.

21. The cap of claim 12 wherein the pop-up style dispensing means is recessed within the cap, wherein when a button along a front periphery of the cap is depressed a front portion of the lid, opposite a rear portion of the lid hingedly attached to the cap, is released to provide access to the pop-up style dispensing means.

22. The cap of claim 12 wherein the dispensing means further comprises a hard plastic backing member underneath a portion of the rubber-like material adjacent the at least one slit opening through which individual wipes are removed from the container.

* * * * *